US006816053B2

(12) United States Patent
Camwell et al.

(10) Patent No.: US 6,816,053 B2
(45) Date of Patent: Nov. 9, 2004

(54) CIRCUIT TO MITIGATE TRANSFORMER SHORTED TURN

(75) Inventors: Paul L. Camwell, Calgary (CA); Wendall L. Siemens, Calgary (CA)

(73) Assignee: Extreme Engineering Ltd., Calgary (CA)

( * ) Notice: Subject to any disclaimer, the term of this patent is extended or adjusted under 35 U.S.C. 154(b) by 0 days.

(21) Appl. No.: 10/402,989

(22) Filed: Apr. 1, 2003

(65) Prior Publication Data

US 2004/0196129 A1 Oct. 7, 2004

(51) Int. Cl.[7] ..... H01F 27/24
(52) U.S. Cl. ..... 336/181; 336/182
(58) Field of Search ..... 336/84 R, 84 C, 336/90, 180–183, 200

(56) References Cited

U.S. PATENT DOCUMENTS 4,691,203 A 9/1987 Rubin et al.
6,146,526 A * 11/2000 Pandolfo ..... 210/222
6,249,259 B1 6/2001 Goodman et al.
6,281,779 B1 * 8/2001 Matsumoto et al. ..... 336/200

* cited by examiner

*Primary Examiner*—Ramon M. Barrera
(74) *Attorney, Agent, or Firm*—Gowling Lafleur Henderson LLP; D. Doak Horne

(57) ABSTRACT

A dual transformer design, each transformer having at least a primary winding and a secondary winding disposed on a core means, wherein the core means is circumferentially disposed about an inner housing means, and the whole structure located within an outer housing. The primary winding of one transformer of said pair of transformers is electrically coupled to the primary winding of the other in a manner such as to cause induced eddy currents from one transformer to be of a magnitude and direction so as to substantially cancel the induced eddy currents from the other transformer.

11 Claims, 7 Drawing Sheets

CIRCUIT TO MITIGATE TRANSFORMER SHORTED TURN

BACKGROUND OF THE INVENTION

1) Field of the Invention

This invention relates to electrical transformers, and more particularly to electrical transformers, that are arranged about an electrically conductive member and surrounded by an electrically conductive housing, as is typically found with transformers employed in down-hole drilling equipment used for the exploration of oil and gas.

2) Description of the Prior Art

Modern drilling techniques employ an increasing number of sensors in down-hole tools to determine down-hole conditions and parameters as pressure, spatial orientation, temperature, gamma ray count etc. encountered during drilling. These sensors are usually employed in a process called 'measurement while drilling' (MWD). The data from such sensors is either transferred to a telemetry device, and thence up-hole to the surface, or is recorded in a memory device by "logging"

The oil and gas industry presently uses either a wire (Wireline), pressure pulses (Mud Pulse) or electromagnetic (EM) signals to telemeter all or part of this information to the surface in an effort to achieve near real-time data. Another telemetry technique is starting to be developed and deployed, namely acoustic telemetry (AT). This technique generally depends on driving a piezoelectric or magnetostrictive element (transducer) via a battery-powered source in order to produce acoustic waves that travel along the drill string, conveying drilling information.

The piezoelectric or magnetostrictive transducer devices normally require a high voltage or large current source respectively, and this is normally delivered from a battery via a transformer and associated electronic circuitry. To make the most efficient use of the annular space, the transformer is wound on a toroidal core and is axially engaged on the inner housing, then covered and protected by the outer housing. Insertion may require the toroidal core to be assembled from two halves. The tubular outer housings must resist tension, compression, torsion, bending, shock and vibration, high pressure and high temperatures in a typically harsh drilling environment. To be adequately strong they are almost always made from steel, titanium or beryllium copper.

A consequence of this choice of materials is that they form excellent electrical conductors. In order to prevent the high pressure drilling fluid and other materials from entering the annular cavities and interfering with the correct working of internal assemblies and components, the inner and outer housings are variously connected with 'o-ring' seals to render the annular space pressure-proof. This requirement in almost all cases also provides an uninterrupted electrical connection between inner and outer housings at each end of the protected annular spaces.

More specifically, a simple downhole housing that contains an axially engaged toroidal transformer in its annular space often forms an electrical short circuit turn around and through the transformer. This shorted turn has a deleterious effect on transformer performance and is conventionally dealt with by inserting a non-conductive material such as a ceramic disc into the housing, thereby electrically opening the shorted turn. (e.g. refer to U.S. Pat. Nos. 6,249,259 B1 and 4,691,203). For instance in a design specifically for a hollow core magnetic dipole, U.S. Pat. No. 6,249,259 B1 shows how to split a conductive sleeve associated with a transformer in a manner that prevents a closed loop from being formed. U.S. Pat. No. 4,691,203 similarly teaches the use of an insulative gap useful in a drill stern/earth telemetry application.

This mechanical solution can lead to mechanical design complications and lessens the robustness of the transformer housing. It is advantageous to remove the need to insert a non-conductive break, particularly in the extremely harsh environment associated with downhole drilling. From an electrical perspective the toroidal transformer is threaded by a low resistance shorted turn, enabling a large current to flow through the housings. This causes the transformer to suffer a significant loss of efficiency. A conventional solution to avoid this issue is to create an electrical break in the current loop, generally implemented by inserting a non-conductive ring. This solution adds complexity and will make the assembly less robust, particularly in the harsh environment associated with drilling. Our invention eliminates the need to interpose a non-conductive ring, thereby maximizing the mechanical reliability of the housing assemblies.

SUMMARY OF THE INVENTION

It is an object of the invention to overcome the deleterious and unintended effects of a shorted turn on transformer applications, particularly for inclusion in tools designed for oil and gas exploration where space to put subassemblies such as transformers is at a premium. It is well known in our industry that incorporating an electrical discontinuity or a significant resistive component can prevent shorted turn effects. By a means novel in our industry we accomplish the objective without incorporating a discontinuity or similar resistive means, thus avoiding the need for extra mechanical modifications and avoiding potential structural weakening of housings containing such transformers.

Our invention recognizes that a transformer works by coupling a primary winding to a secondary winding by a time-varying magnetic field. This magnetic field is generally confined to the core, but fields generated external to the transformer associated with current in the windings couple into the inner and outer metal tubular housings and generate eddy currents. These eddy currents combine in concert when a continuous electrical path is available and cause the shorted turn large current effect. Our invention is to accept this effect in order to maintain a simpler and more robust mechanical enclosure around the transformer, but mitigate it by providing a second transformer and inducing an equal but opposite current derived from a second similar transformer disposed on and within the same tubular housings as the first. The net effect is that each transformer, in generating its own shorted turn current, ideally negates that of the other, leaving no net current flow in the shorted turn conductor path.

The output of each transformer may be connected such that they combine to drive a common load or even a split load. The important issue is that the transformers are substantially balanced in operation such that they generate equal (or nearly so) but opposite shorted turn currents.

Accordingly, in a broad aspect of our invention, such invention comprises a pair of transformers, each substantially similar-sized and substantially housed in electrically-conductive outer housing means, said pair of transformers located in close proximity to each other within said outer housing means, each transformer comprising at least a primary winding and a secondary winding, (a) each of said primary and secondary windings disposed about an inner electrically conductive member;

(b) each of said pair of transformers, when a current is passed through said primary winding thereof, inducing a respective eddy current; and (c) said primary winding of each transformer electrically connected to the primary winding of the other transformer so that the induced eddy current of one of said transformers is substantially equal but opposite in direction to the induced eddy current of the other of said transformers so as to substantially cancel each other out.

In another broad aspect of the invention, such invention comprises a pair of transformers, substantially housed in electrically-conductive outer housing means, said pair of transformers located in close proximity to each other within said outer housing means, each transformer comprising at least a primary winding and a secondary winding, (a) each of said primary and secondary windings disposed about an inner electrically conductive member in electrical communication with said outer housing means; and (b) said primary winding of a first of said pair of transformers electrically connected to the primary winding of the other of said pair of transformers so that electrical current, when caused to pass in the primary winding of the first transformer, runs in a direction opposite to electrical current in the primary winding of the other transformer.

The invention allows eddy currents to be harmlessly generated in the shorted turn, as eddy currents generated by one primary winding of the first transformer are substantially opposed in magnitude and sense by eddy currents induced by opposite current flow in the primary winding of the other transformer. By "splitting" the original transformer into two or more transformers, and connecting the windings thereof such that the eddy currents generated in the shorted turn formed by the housings are substantially split into equal and opposing currents, thereby nullifying any net significant current flow, the advantage is that close to the previous transformer efficiency can be realized.

Advantageously, this result is achieved in almost the same annular space as a single transformer, without having to insert an electrically non-conductive member to prevent the shorted turn from reducing the transformer efficiency, thereby maintaining structural integrity of the outer housing which is necessary in down-hole drilling environments in which these transformers are typically exposed.

Accordingly, in yet a further embodiment, the present invention comprises a multiple transformer design of three or more similarly-sized transformers, each transformer comprising at least a primary winding and a secondary winding disposed on core means;

(a) said core means circumferentially disposed about an inner housing means;

(b) each transformer and inner housing member being materially encapsulated within an outer housing means, said outer housing means and said inner housing means together forming a common electrical shorted turn about each transformer;

(c) the secondary winding of each transformer being electrically coupled to an electrical load;

(d) each of said pair of transformers, when an electrical current is passed through said primary winding thereof, inducing an eddy current within said shorted turn; and (e) the primary winding of each transformer electrically coupled to the primary winding of the other in a manner such as to cause the induced eddy currents from one transformer that flow around said shorted turn to be of a magnitude and direction so as to substantially cancel combined induced eddy currents from the other transformers.

BRIEF DESCRIPTION OF THE DRAWINGS

Further embodiments will appear from the following detailed description of various preferred embodiments of the invention, taken together with the accompanying drawings, in which.

DETAILED DESCRIPTION OF PREFERRED EMBODIMENTS

Figure 1:
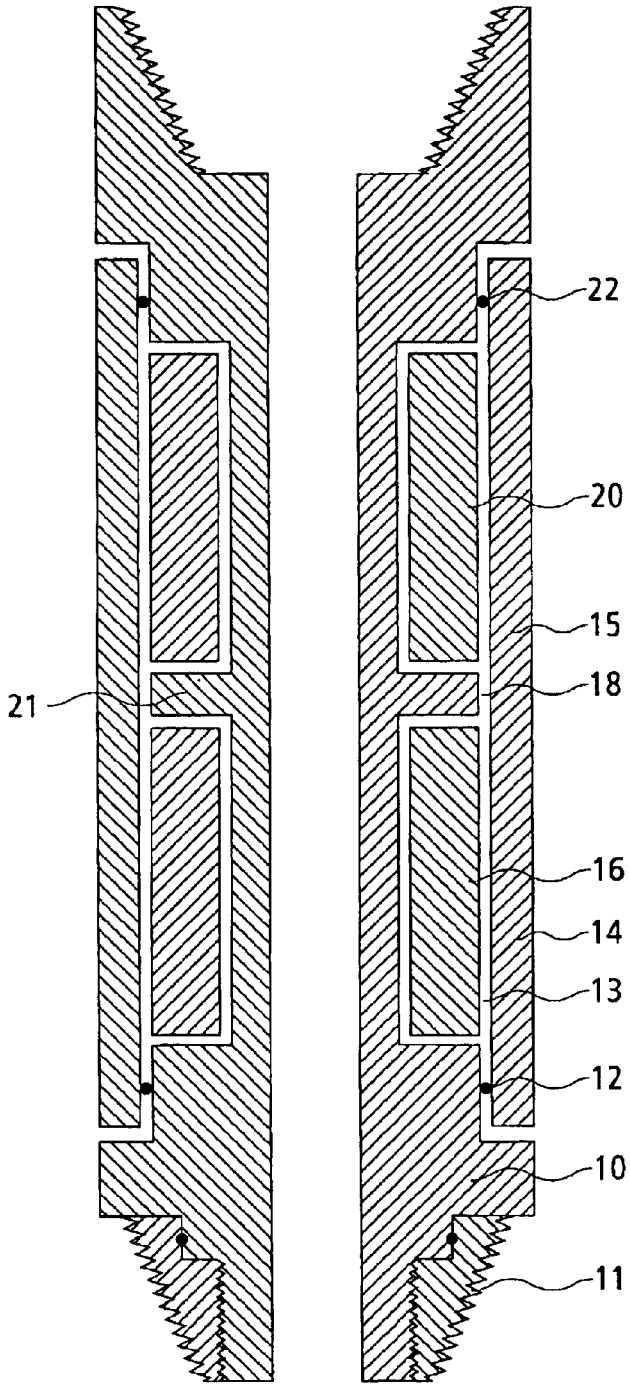
FIG. 1 is an axial cross section of a greatly simplified MWD housing showing how a ceramic transducer and toroidal transformer are mounted. The annular space is mostly taken up by these components in order to optimize efficiency.

For ease of reference, like components of the various figures are identified where possible by the same reference numbers. Referring to FIG. 1 (prior art), an inner housing 10, end cap 11 and an outer housing 14 are typically designed to be attached to a drill string by threaded connections. The purpose of such a device (called a 'sub') is to house various devices (sensors, batteries, actuators etc.) in an annular space 18. In our example we show a very simple sub appropriate to acoustic telemetry housing a ceramic actuator 16 and a driver transformer 20 located coaxially on the inner housing 10 and separated by disc-like bulkheads 21 incorporated into the inner housing 10. The external pressure may rise to 20,000 psi, so a method of sealing the annular space 13 between the outer housing 15 and inner housing 10 is incorporated, usually via 'o-ring' seals 12 and 22.

Figure 2A:
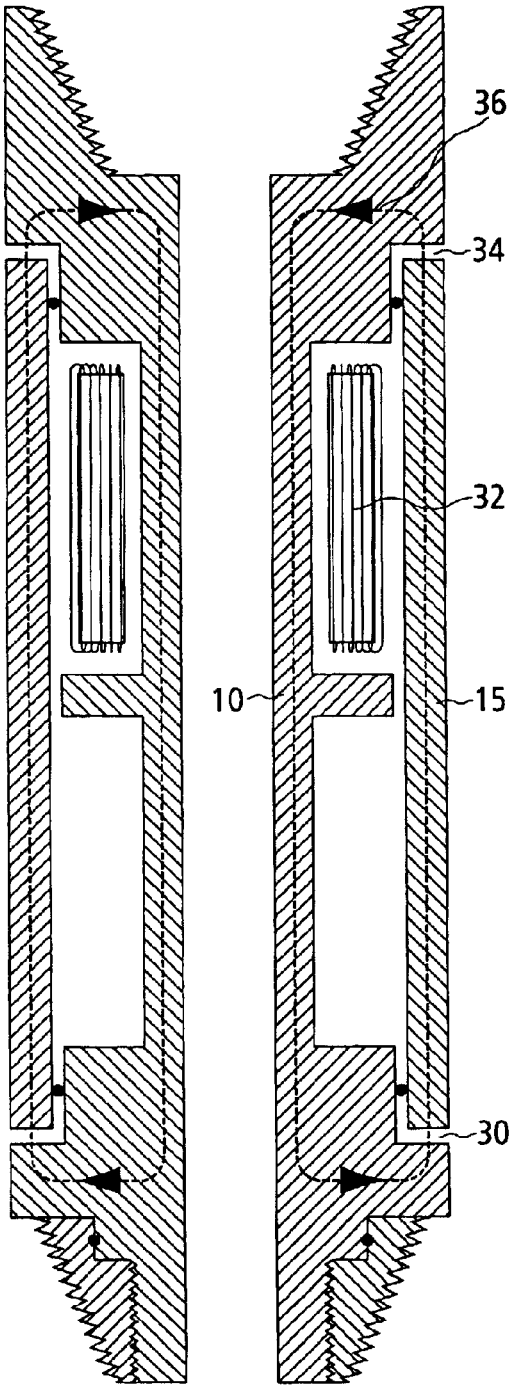
FIG. 2A indicates how the toroidal transformer is wound.
Figure 2B:
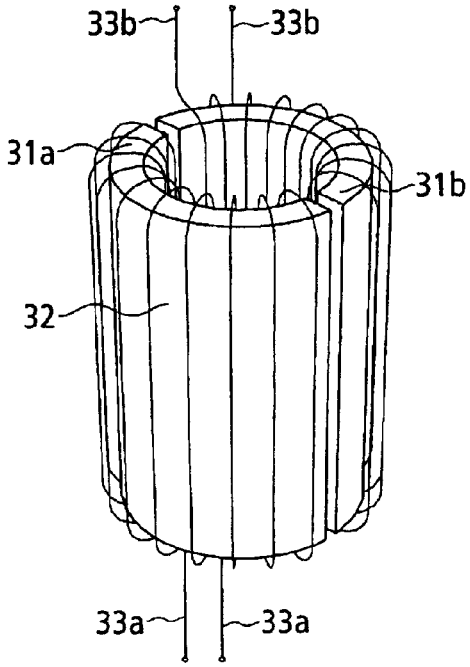
FIG. 2 is a similar axial cross section of an MWD housing but indicates the current path associated with a shorted turn.

Referring to FIG. 2 (prior art), the toroidal transformer 32 that drives the ceramic transducer 16 for AT purposes is advantageously wound on a toroidal core comprising two annular half-members 31*a* and 31*b*, with primary windings 33*a* and secondary windings 33*b* in order that it is more easily inserted on to the inner housing 10. Windings 33*a* and 33*b* may necessarily be electrically interrupted by building the core from two parts 31*a*, 31*b*, as shown in FIG. 2A, in which case they would be reconnected upon assembly in order that appropriate transformer action takes place. Such resulting toroidal transformer 32 takes up most of the annular space between the outer diameters of the inner housing 10 and outer housing 15. Because its power is directly related to its volume, and a toroidal shape maximizes its volume for this application, such design provides optimum efficiency.

The sub environment is extremely harsh, particularly with respect to shock, vibration, rotation and bending. The outer housing 15 is beneficially constrained to be mechanically well supported by the inner housing 10 to prevent any relative motion that could cause loss of structural integrity or a pressure leak. The housings 10, 15 are therefore in intimate mechanical contact, and form a conductive pathway at points 30 and 34 where they are joined. A consequence of the orientation of the windings 33*a*, 33*b* is that an eddy current will be induced in any conductive circuit that threads or comprises a shorted turn through the transformer. As shown in FIG. 2 the housing assembly 15 enables a current 36 comprising the sum of individual eddy currents generated by the transformer 32 to flow in the direction of the arrows shown in FIG. 2. To those skilled in the art, it is obvious that current 36 is actually an alternating current synchronous with the transformer energizing frequency and exists because the inner housing 10 passes through the center of the core comprising the two half-members 31*a*, 31*b*, and, with the addition of outer housing 15, forms a 'shorted turn secondary winding'. This formed shorted turn, where current is able to flow in such a shorted turn, is highly undesirable and greatly reduces transformer efficiency.

Figure 3:
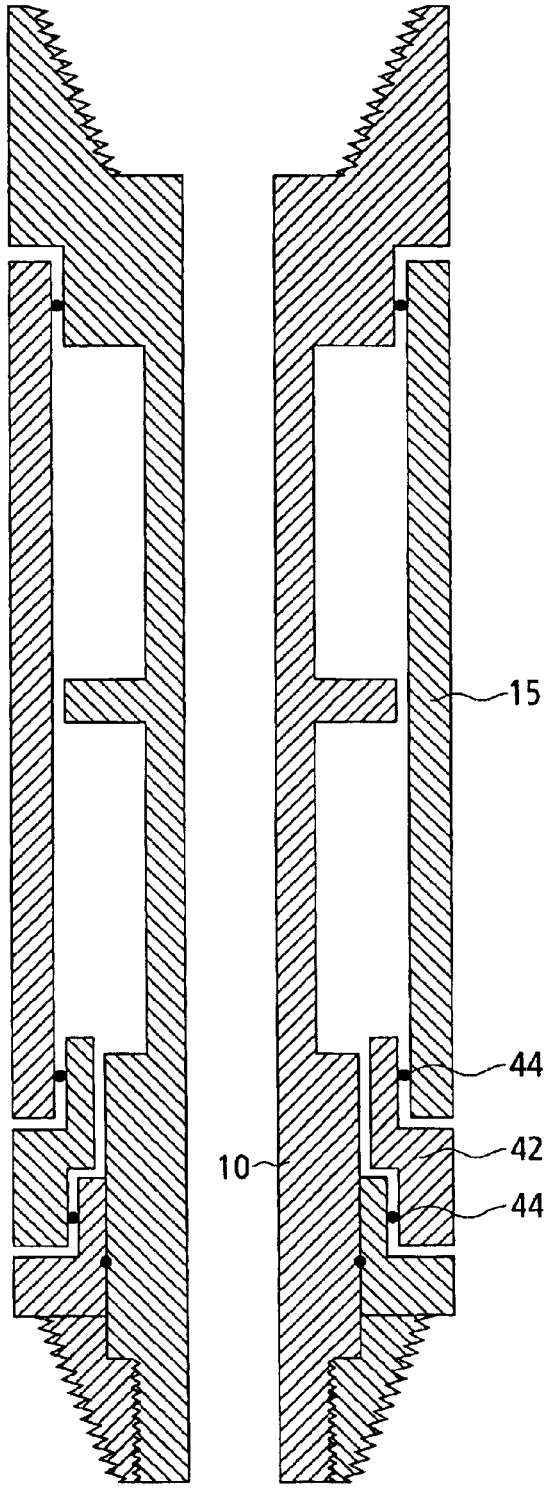
FIG. 3 shows how the inclusion of a non-conductive ring can break the shorted turn.

In order to prevent this induced current 36 from flowing, it is usual to insert a non-conductive break into the current loop 36 formed within the housings 10, 15, or similar means. In FIG. 3 we show a well-known method of introducing a simple and quite general mechanical method of opening a closed loop in MWD housings 10, 15 by incorporating a non-conductive ring 42 that electrically separates inner housing 10 from outer housing 15. The necessary pressure seals 44 are maintained by 'o-rings' as normal. The disadvantage of such mechanical solutions to the shorted turn issue is that there is a net loss of mechanical integrity caused by the necessary introduction of a relatively weak non-conductive material into the housing structure.

Figure 4:
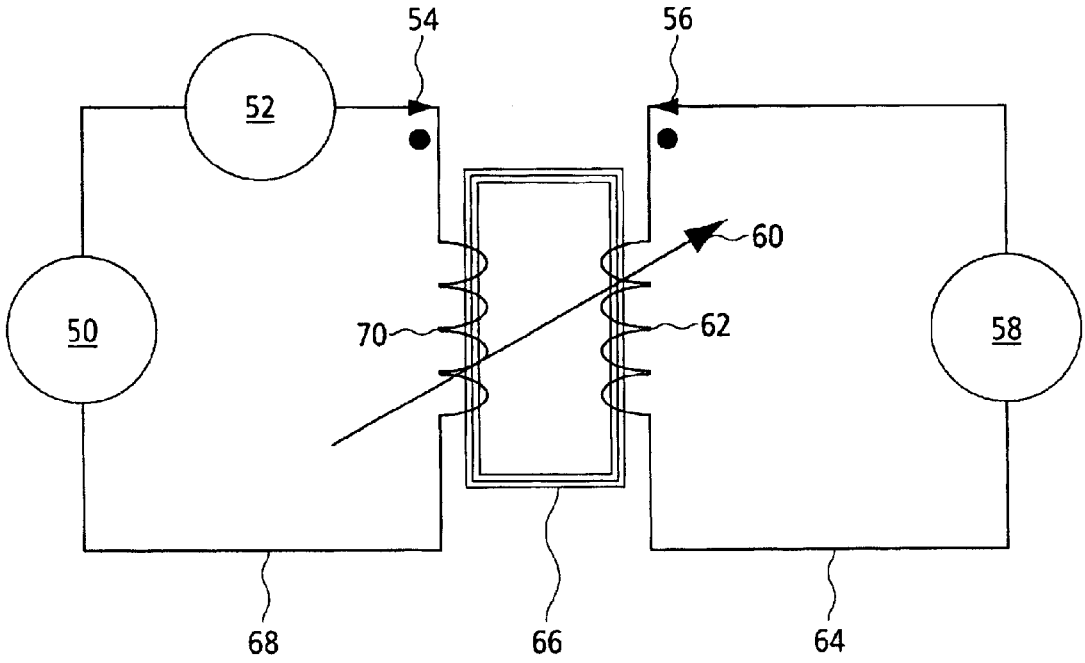
FIG. 4 presents an electrical representation of a simple transformer.

The importance of preventing a shorted turn current from occurring will be understood by inspection of FIG. 4 and the following analysis. FIG. 4 represents a simple transformer comprising a primary coil 68 and a secondary coil 64 wound on a common core 66. The primary winding is energized by a source of alternating voltage 50 that has an impedance 52, generating a primary current 54. The secondary winding generates a secondary current 56 through a load 58. There is a mutual inductance 60 between primary and secondary windings.

The following analysis (see reference: Bleaney and Bleaney) will show how such a transformer can be used to provide a power source for a given load and how a shorted turn significantly affects this operation. We define certain parameters:

| | |
|---|---|
| ac input voltage 50 = | $V_1$ |
| primary impedance 52 = | $Z_1$ |
| primary inductance 70 = | $L_1$ |
| (comprising $n_1$ turns) | |
| primary current 54 = | $I_1$ |
| secondary impedance 58 = | $Z_2$ |
| secondary inductance 62 = | $L_2$ |
| (comprising $n_2$ turns) | |
| secondary current 56 = | $I_2$ |
| mutual inductance 60 = | M |

A generalized form of Ohm's law yields:

$$V_1=(Z_1+j\omega L_1)I_1+j\omega MI_2 \quad [1]$$

$$0=(Z_2+j\omega L_2)I_2+j\omega MI_1 \quad [2]$$

where:

$\omega=2\pi f$ f=frequency $j=\sqrt{-1}$

Manipulation of equations [1] and [2] leads to:

$$V_1/I_1=Z_1+j\omega L_1+\omega^2M/(Z_2+j\omega L_2) \quad [3]$$

$$(M/L_1)(V_1/I_2)=j\omega(M^2/L_1-L_2)-Z_1(L_2/L_1)-Z_2 \quad [4]$$

The mutual inductance M is defined as:

$$M=k\sqrt{(L_1L_2)} \quad [5]$$

where:

k=coupling coefficient

An imperfect transformer is one where the magnetic coupling between primary winding and secondary winding is less than 100%—it follows that k<1 in these cases.

Further manipulation of [3], [4] and [5] to determine the current in the secondary winding yields:

$$I_2=(-knV_1)/\{(Z_2+Z_1n^2+j\omega L_2(1-k^2)\} \quad [6]$$

where: $n=n_2/n_1=\sqrt{(L_2/L_1)}$, the 'turns ratio'

After separating equation [6] into real and imaginary parts and performing-the vector addition, inserting the following values appropriate to a practical transformer and load will yield a value for $I_2$:

$V_1$=50 volts peak k=0.93 n=10

(when $n_1$=22 and $n_2$=220)

$Z_1$=1 ohm $Z_2$=300 ohm $L_1$=1000 $\mu$H f=600 Hz

Thus:

$I_2$~1.2 amps peak

To assess the impact of a shorted turn, we convert the secondary winding to a single turn and reduce $Z_2$ to a value typical of the resistance measured across solid steel housing. The specific values are as follows:

$n_2$=1

$Z_2$=0.05 ohms

Thus:

$I_2$~41 amps peak

Assuming the ac source $V_1$ is able to fully drive the shorted turn, this simple calculation indicates that a current on the order of several tens of amps will be uselessly dissipated in the secondary winding now dominated by the very low impedance of the shorted turn. Measurements have verified the magnitude of $I_2$ as predicted by equation [6] and have shown that the output voltage able to drive a load is severely reduced in comparison to the non-shorted situation. In a downhole AT application this effect would be disastrous, particularly as batteries form the basic source of electrical power.

Figure 5:
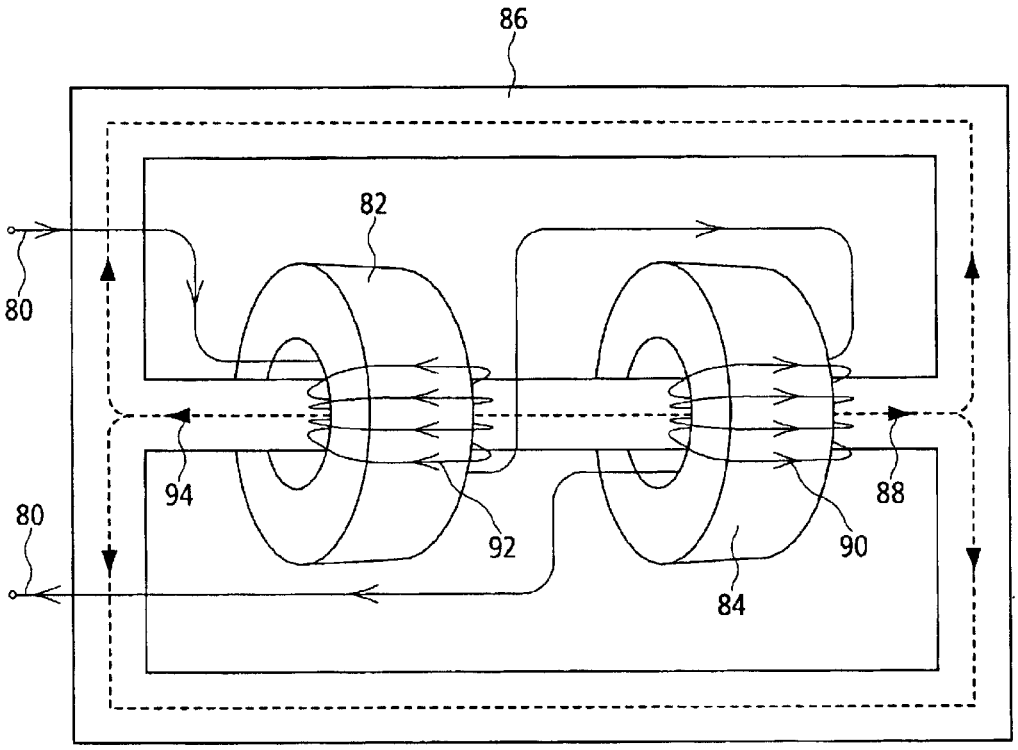
FIG. 5 is an electrical perspective of an embodiment of the present invention detailing two toroidally-wound transformers that generate two equal but opposite shorted turn currents.

Our invention retains the advantages of the strong and uncomplicated housing as illustrated in FIG. 1 but necessitates a modification of the transformer design, as indicated in FIG. 5. As may be seen from FIG. 5, single transformer 20 now becomes double transformers 82 and 84. For clarity only the primary windings 90 and 92 are shown energized by input source 80. They are connected in series opposition. The housings 10, 15 forming a shorted turn represented by conductor 86 enable eddy currents 88 and 94 to exist. Current 88 is shown as flowing from left to right, and current 94 flowing from right to left. This is a consequence of the sense of the windings in each transformer 82 and 84. The transformers are designed in a balanced fashion such that when in operation the two shorted turn currents 88, 94 are equal and opposite, thus negating the shorted turn high current effect.

Figure 6:
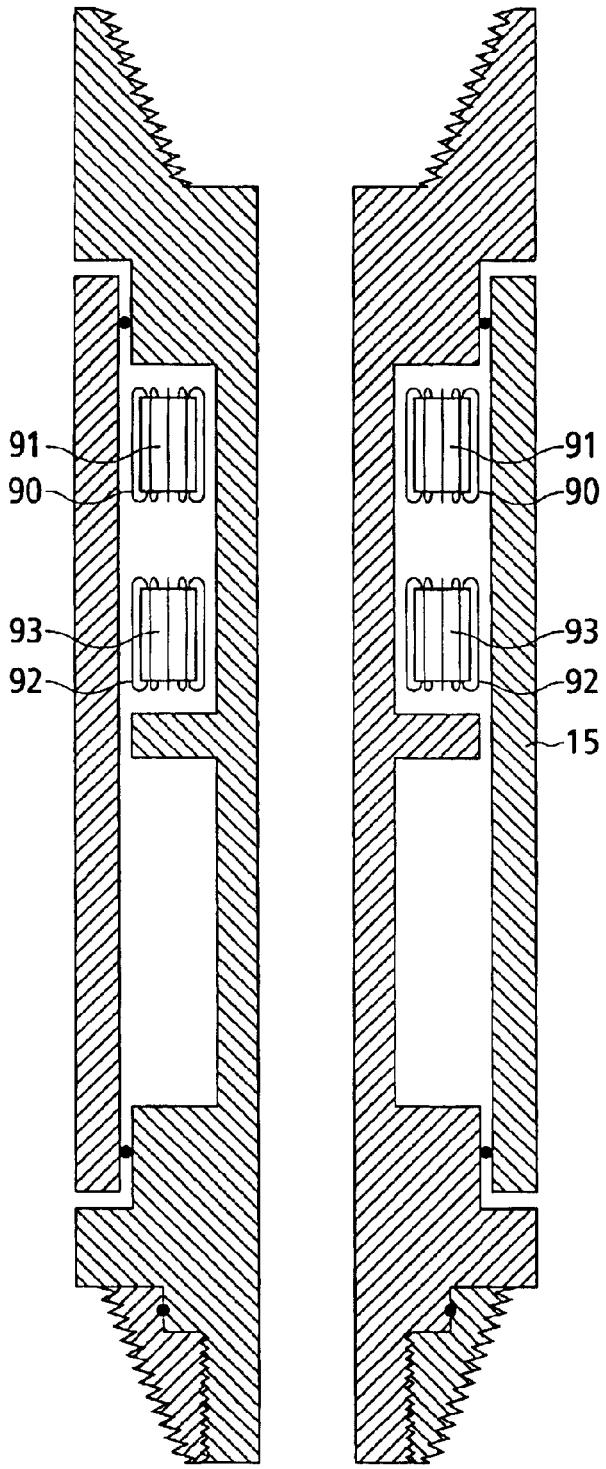
FIG. 6 indicates how two similar transformers are disposed on an MWD housing that previously utilized one transformer.

FIG. 6 shows a MWD housing, where the present invention has been put into effect. Specifically, FIG. 6 shows two similarly (half) sized transformers 91, 93 disposed in the MWD housing 15. The two transformers 91, 93 are configured so that the current in primary winding 90 of transformer 91 is adapted to travel in the opposite direction to current traveling in primary winding 92 of transformer 93.

Figure 7A:
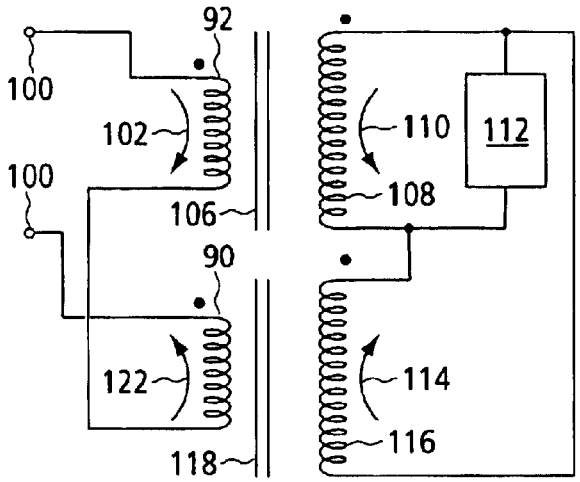
FIG. 7A shows an electrical schematic of one embodiment in coupling an electrical load to the pair of transformers of the present invention.
Figure 7B:
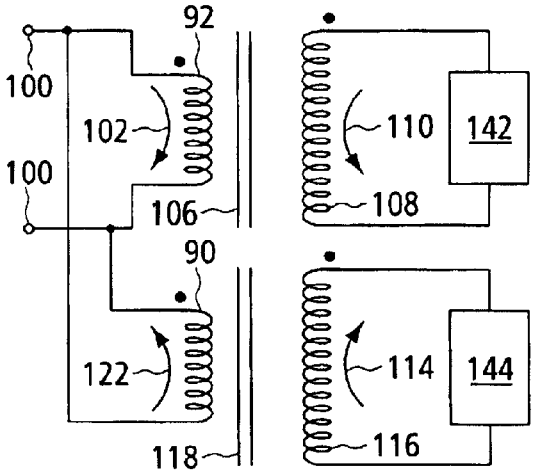
FIG. 7B shows an electrical schematic of a second embodiment in coupling two electrical loads to the pair of transformers of the present invention.
Figure 7C:
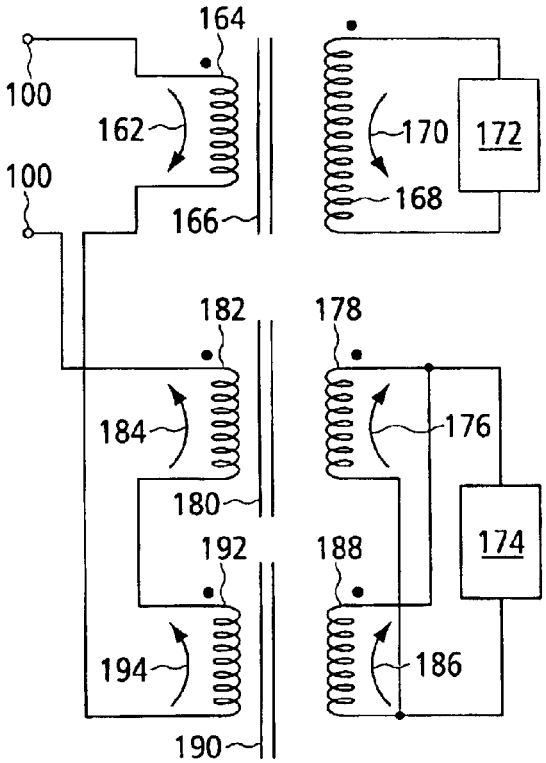
FIG. 7C shows an electrical schematic of a third embodiment for electrically coupling two electrical loads to three transformers of the present invention.

There are many ways to configure transformers that operate on a common conductor comprising a shorted turn—FIGS. 7A-C show three examples. FIG. 7A indicates two similar transformers driven from a common source 100. The two primary windings 92 and 90 are connected in series opposition as indicated by primary winding currents 102 and 122 respectively. Core 106 couples primary winding 92 to secondary winding 108, producing secondary current 110 into load 112. Similarly core 118 couples primary 90 to secondary winding 116, producing secondary current 114 into load 112. Because the primary windings are connected in opposite senses, the secondary currents 110, 114 are connected as shown to combine appropriately in load 112. It will be understood that the shorted turn currents are generated by the primary and secondary currents 102, 122, and 110, 114 respectively via the means of induced magnetic fields associated with normal transformer action. It is these fields that induce the shorted turn currents. Thus the sense of the currents in the primary 90, 92 and secondary windings 108, 116 dictates the sense of the shorted turn currents. In order for the induced shorted turn currents to substantially cancel, in the preferred embodiment the transformers operate almost identically. This requires current 102 to be closely matched to current 122, given that both transformers are closely similar, and are disposed on the housings in an identical manner. Any imbalance will contribute to a net short circuit current.

FIG. 7B indicates how the invention is applied to separate and independent loads. A common source 100 drives two similar primary windings 90 and 92 in parallel producing two opposite sense currents 102 and 122. These currents are coupled by cores 106 and 118 to their respective secondary windings 108 and 116 to produce secondary currents 114 and 110. These independently drive loads 142 and 144 as indicated. As long as the two loads 142 and 144 are similar, the secondary currents 110, 114 also similarly affect the two primary currents 102, 122 via the mutual impedances. Therefore if currents 102 and 122 are reasonably identical they will generate two equivalent shorted turn eddy currents that oppose and negate each other.

FIG. 7C indicates how the invention is applied to three transformers and two loads. A common source 100 drives primary windings 164, 182 and 192, with all three connected in series. Primary currents 184 and 194 circulate in the same sense, which is opposite to primary current 162. As before, the cores 166, 180 and 190 couple to secondary windings 168, 178 and 188, thereby generating secondary currents 170, 176 and 186 respectively. Current 170 is applied to load 172 whilst currents 176 and 186 are applied in parallel to load 174. The significant issue associated with the main embodiment of the present invention is to ensure that the two transformers powering load 174 jointly produce a shorted turn current that is equal to and opposite in sense to the shorted turn current from the transformer powering load 172.

As compared to the prior art single transformer, our invention in a preferred embodiment employs a pair of transformers. Each transformer is preferably approximately half the original size, in order to generate the same power in the common load. The extra complication of another transformer is more than made up for by the straightforward canceling of eddy currents flowing in a shorted turn and with the ability to retain an otherwise stronger, simpler and more robust inner and outer housing assembly compared to an assembly including an insulating gap.

We have illustrated obvious extensions of our invention by incorporating more than two transformers and more than one load where this may happen to be advantageous. The issue is that the current flowing from the coupled primary and secondary windings that comprise each transformer may induce eddy currents in the common low resistance shorted turn formed by the housing assembly. This deleterious effect may be mitigated by connecting the primaries of the transformers using a parallel, series or mixed scheme, also with judicious attachment of the load or loads to the appropriate secondary windings. The basic concept applies—drive the transformer ensemble such that the total set of shorted turn currents are summed ideally to zero or are at least adequately small. There are numerous ways to connect the various transformer windings in order to achieve this effect, as will be obvious to one reasonably skilled in the art.

Specifically, although the disclosure describes and illustrates preferred embodiments of the invention, it is to be understood that the invention is not limited to these particular embodiments. Many variations and modifications will now occur to those skilled in the art. For definition of the invention, reference is to be made to the claims appended hereto.

We claim:

1. A dual transformer design comprising two substantially similar-sized transformers, each transformer comprising at least a primary winding and a secondary winding disposed on core means;

(a) said core means circumferentially disposed about an inner housing means;

(b) each transformer and inner housing member being materially encapsulated within an outer housing means, said outer housing means and said inner housing means together forming a common electrical shorted turn about each transformer;

(c) the secondary winding of each transformer being electrically coupled to a common electrical load;

(d) each of said pair of transformers, when an electrical current is passed through said primary winding thereof, inducing an eddy current within said shorted turn; and (e) the primary winding of each transformer electrically coupled to the primary winding of the other in a manner such as to cause the induced eddy currents from one transformer that flow around said shorted turn to be of a magnitude and direction so as to substantially cancel the induced eddy currents from the other transformer.

2. A dual transformer design comprising two similarly sized transformers, each transformer comprising at least a primary winding and a secondary winding disposed on core means;

(a) said core means circumferentially disposed about an inner housing means;

(b) each transformer and inner housing member being materially encapsulated within an outer housing means, said outer housing means and said inner housing means together forming a common electrical shorted turn about each transformer;

(c) the secondary winding of each transformer being independently electrically coupled to a separate electrical load;

(d) each of said pair of transformers, when an electrical current is passed through said primary winding thereof, inducing an eddy current within said shorted turn; and (e) the primary winding of each transformer electrically coupled to the primary winding of the other in a manner such as to cause the induced eddy currents from one transformer that flow around said shorted turn to be of a magnitude and direction so as to substantially cancel the induced eddy currents from the other transformer.

3. A multiple transformer design comprising three or more transformers, each transformer substantially similar-sized and comprising at least a primary winding and a secondary winding disposed on core means;

(a) said core means circumferentially disposed about an inner housing means;

(b) each transformer and inner housing member being materially encapsulated within an outer housing means, said outer housing means and said inner housing means together forming a common electrical shorted turn about each transformer;

(c) the secondary winding of each transformer being electrically coupled to an electrical load;

(d) each of said transformers, when an electrical current is passed through said primary winding thereof, inducing an eddy current within said shorted turn; and (e) the primary winding of each transformer electrically coupled to the primary windings of the other transformers in a manner such as to cause the induced eddy currents from one transformer or set of transformers that flow around said shorted turn to be of a magnitude and direction so as to substantially cancel combined induced eddy currents from the other transformers.

4. A pair of transformers, each transformer substantially similar-sized and substantially housed in electrically-conductive outer housing means, said pair of transformers located in close proximity to each other within said outer housing means, each transformer comprising at least a primary winding and a secondary winding, (a) each of said primary and secondary windings disposed about an inner electrically conductive member;

(b) each of said pair of transformers, when a current is passed through said primary winding thereof, inducing a separate respective eddy current; and (c) said primary winding of each transformer electrically connected to the primary winding of the other transformer so that the induced eddy current of one of said transformers is substantially equal but opposite in direction to the induced eddy current of the other of said transformers when connected to loads so as to substantially cancel each other out.

5. The pair of transformers as claimed in claim 4, wherein said inner member, but for said equal but opposite induced eddy current, would otherwise form an electrically shorted turn with said outer housing means when current is caused to flow in said primary windings of said pair of transformers.

6. The pair of transformers as claimed in claim 5, wherein each of said primary and secondary windings of each transformer is disposed about core means, said core means disposed about a periphery of said inner electrically conductive member.

7. The pair of transformers as claimed in claim 6, wherein said inner member is substantially cylindrical and positioned so as to be substantially circumferentially surrounded by said core means.

8. The pair of transformers as claimed in claim 7, wherein said core means comprises two hollow substantially cylindrical half-members, circumferentially disposed about said inner member.

9. The pair of transformers as claimed in claim 8, wherein said core means of one of said pair of transformers is in juxtaposed but axially spaced-apart position relative to the core means of the other of said pair of transformers.

10. The pair of transformers as claimed in claim 4 wherein said transformers are contained in said outer housing means and such transformers and outer housing means are adapted for sub-surface use as part of a downhole drilling tool.

11. A pair of transformers, substantially housed in electrically-conductive outer housing means, said pair of transformers located in close proximity to each other within said outer housing means, each transformer comprising at least a primary winding and a secondary winding, (a) each of said primary and secondary windings disposed about an inner electrically-conductive member in electrical contact with the electrically-conductive outer member; and (b) said primary winding of a first of said pair of transformers electrically connected to the primary winding of the other of said pair of transformers so that electrical current when caused to pass in the primary winding of the first transformer runs in a direction opposite to electrical current in the primary winding of the other transformer.

* * * * *